US009549264B2

(12) United States Patent
Kim et al.

(10) Patent No.: US 9,549,264 B2
(45) Date of Patent: Jan. 17, 2017

(54) PORTABLE TERMINAL FOR CONTROLLING HEARING AID AND METHOD THEREFOR

(71) Applicant: Samsung Electronics Co., Ltd., Suwon-si, Gyeonggi-do (KR)

(72) Inventors: Jung-Soo Kim, Hwaseong-si (KR); Ik-Soo Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 159 days.

(21) Appl. No.: 14/180,985

(22) Filed: Feb. 14, 2014

(65) Prior Publication Data

US 2014/0233774 A1 Aug. 21, 2014

(30) Foreign Application Priority Data

Feb. 15, 2013 (KR) ..... 10-2013-0016624

(51) Int. Cl.
*H04R 25/00* (2006.01)

(52) U.S. Cl.
CPC ..... *H04R 25/30* (2013.01); *H04R 25/552* (2013.01); *H04R 25/554* (2013.01); *H04R 25/556* (2013.01); *H04R 25/558* (2013.01); *H04R 2225/41* (2013.01); *H04R 2225/55* (2013.01)

(58) Field of Classification Search
CPC ..... H04R 25/55; H04R 25/552; H04R 25/554; H04R 25/556; H04R 25/558; H04R 25/30; H04R 2225/41; H04R 2225/55
USPC ..... 381/315
See application file for complete search history.

(56) References Cited

U.S. PATENT DOCUMENTS

| | | | | |
|---|---|---|---|---|
| 6,707,921 | B2 | 3/2004 | Moore | |
| 7,365,766 | B1 | 4/2008 | Lapalme | |
| 2003/0099370 | A1 | 5/2003 | Moore | |
| 2004/0066945 | A1 | 4/2004 | Fischer et al. | |
| 2008/0232618 | A1 | 9/2008 | Jahannesson | |
| 2010/0137042 | A1 | 6/2010 | Na et al. | |
| 2010/0254540 | A1 | 10/2010 | Bang | |
| 2010/0284556 | A1 | 11/2010 | Young | |
| 2010/0302239 | A1 | 12/2010 | Tokita et al. | |
| 2011/0013075 | A1* | 1/2011 | Kim | H04N 5/602 348/370 |
| 2011/0044483 | A1 | 2/2011 | Edgar | |
| 2011/0123056 | A1 | 5/2011 | Aboulnasr et al. | |
| 2011/0137656 | A1 | 6/2011 | Xiang et al. | |
| 2011/0200214 | A1* | 8/2011 | Knox | H04R 25/50 381/314 |
| 2011/0200215 | A1* | 8/2011 | Apfel | H04R 25/70 381/314 |

(Continued)

FOREIGN PATENT DOCUMENTS

| | | |
|---|---|---|
| EP | 1653773 A2 | 5/2006 |
| EP | 2 670 196 A1 | 1/2012 |

(Continued)

*Primary Examiner* — Duc Nguyen
*Assistant Examiner* — Sean H Nguyen
(74) *Attorney, Agent, or Firm* — Jefferson IP Law, LLP

(57) ABSTRACT

A method for controlling a hearing aid using a portable terminal is provided. The method includes taking a photo, generating a control signal to control a hearing mode of the hearing aid according to an analysis of a surrounding condition based on the photo, and transmitting the control signal to the hearing aid.

34 Claims, 11 Drawing Sheets

(56) References Cited

U.S. PATENT DOCUMENTS

| | | | | |
|---|---|---|---|---|
| 2011/0200217 | A1* | 8/2011 | Gurin | A61B 5/123 381/320 |
| 2012/0183164 | A1 | 7/2012 | Foo et al. | |
| 2012/0229647 | A1* | 9/2012 | Calman | G08B 21/24 348/158 |
| 2013/0022223 | A1* | 1/2013 | Kehtarnavaz | H04R 25/70 381/317 |
| 2013/0057575 | A1* | 3/2013 | An | H04N 13/047 345/619 |
| 2013/0230179 | A1* | 9/2013 | Beaty | H04S 7/40 381/56 |
| 2013/0316711 | A1 | 11/2013 | Nakamura et al. | |
| 2014/0080482 | A1 | 3/2014 | Yasuoka et al. | |

FOREIGN PATENT DOCUMENTS

| | | | |
|---|---|---|---|
| EP | 2 717 629 | A1 | 4/2014 |
| KR | 10-2009-0105531 | A | 10/2009 |
| KR | 10-2010-0111118 | A | 10/2010 |
| WO | 2010/029424 | A1 | 3/2010 |
| WO | 2012/102106 | A1 | 2/2012 |
| WO | 2012/164694 | A1 | 6/2012 |

* cited by examiner

PORTABLE TERMINAL FOR CONTROLLING HEARING AID AND METHOD THEREFOR

CROSS-REFERENCE TO RELATED APPLICATION(S)

This application claims the benefit under 35 U.S.C. §119 (a) of a Korean patent application filed on Feb. 15, 2013 in the Korean Intellectual Property Office and assigned Serial No. 10-2013-0016624, the entire disclosure of which is hereby incorporated by reference.

TECHNICAL FIELD

The present disclosure relates to a portable terminal. More particularly, the present disclosure relates to a portable terminal and method for controlling a hearing aid.

BACKGROUND

Recent portable terminals provide more diverse services and optional functions. To improve usefulness of the portable terminal and meet different desires of users, various practical applications have been developed. For this reason, recent portable terminals, such as smartphones and tablet Personal Computers (tablet PCs) may have up to hundreds of applications available.

Objects or shortcut icons for running the applications are displayed on the touch screen of the portable terminal. The user may run a desired application in the portable terminal by touching a corresponding shortcut icon displayed on the touchscreen. In addition to those shortcut icons, other visual objects of various shapes, such as widgets, photos, and text may also be displayed on the touch screen of the portable terminal. The portable terminal may control the objects or applications using an input unit, such as the user's finger, an electronic pen, a stylus pen, and the like.

Applications that may provide convenience for disabled people through the portable terminal are now being developed and there is a need for portable terminals to provide useful functions that help deaf people enjoy better-quality sounds by using applications running in the portable terminal with a camera equipped in the portable terminal, and the like.

To date, hearing aids have merely amplified surrounding sounds for output to the user. Hearing aids according to the related art have only provided several predetermined hearing modes and have not yet adaptively selected a hearing mode for a current surrounding condition around the user. Accordingly, a need exists for a method for controlling a hearing aid in order to provide more realistic sounds to a person with disability in hearing.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure provides a portable terminal and method for controlling a hearing aid to provide highly improved service for a user wearing the hearing aid.

In accordance with an aspect of the present disclosure, a method for controlling a hearing aid using a portable terminal is provided. The method includes taking a photo, generating a control signal to control a hearing mode of the hearing aid according to an analysis of a surrounding condition based on the photo, and transmitting the control signal to the hearing aid.

In accordance with another aspect of the present disclosure, a portable terminal for controlling a hearing aid is provided. The portable terminal includes a camera module configured to take a photo, a controller configured to analyze a surrounding condition based on the photo and to generate a control signal to control a hearing mode of the hearing aid according to a result of the analysis, and a transceiver configured to transmit the control signal to the hearing aid.

In accordance with another aspect of the present disclosure, a method of changing a hearing mode in a hearing aid is provided. The method includes receiving a control signal to control the hearing mode of the hearing aid from a portable terminal, extracting a hearing mode according to an analysis of the control signal, and changing the hearing mode of the hearing aid to the extracted hearing mode.

In accordance with another aspect of the present disclosure, a hearing aid is provided. The hearing aid includes a Radio Frequency (RF) unit configured to transmit to a portable terminal at least one hearing mode that the hearing aid offers, and to receive from the portable terminal a control signal to change a hearing mode of the hearing aid to another hearing mode, and a controller configured to extract a hearing mode from the control signal and to control a hearing mode of the hearing aid to be changed to the hearing mode extracted from the control signal.

In accordance with another aspect of the present disclosure, a method for changing a hearing mode in a hearing aid is provided. The method includes taking a photo, determining a surrounding condition from the photo, controlling the hearing mode of the hearing aid according to the determined surrounding condition, and outputting a sound in the hearing mode.

In accordance with another aspect of the present disclosure, a hearing aid is provided. The hearing aid includes a photo shoot unit configured to take a photo, a controller configured to control a hearing mode of the hearing aid by determining a surrounding condition from the photo, and an output unit configured to output a sound in the hearing mode.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

Figure 1:
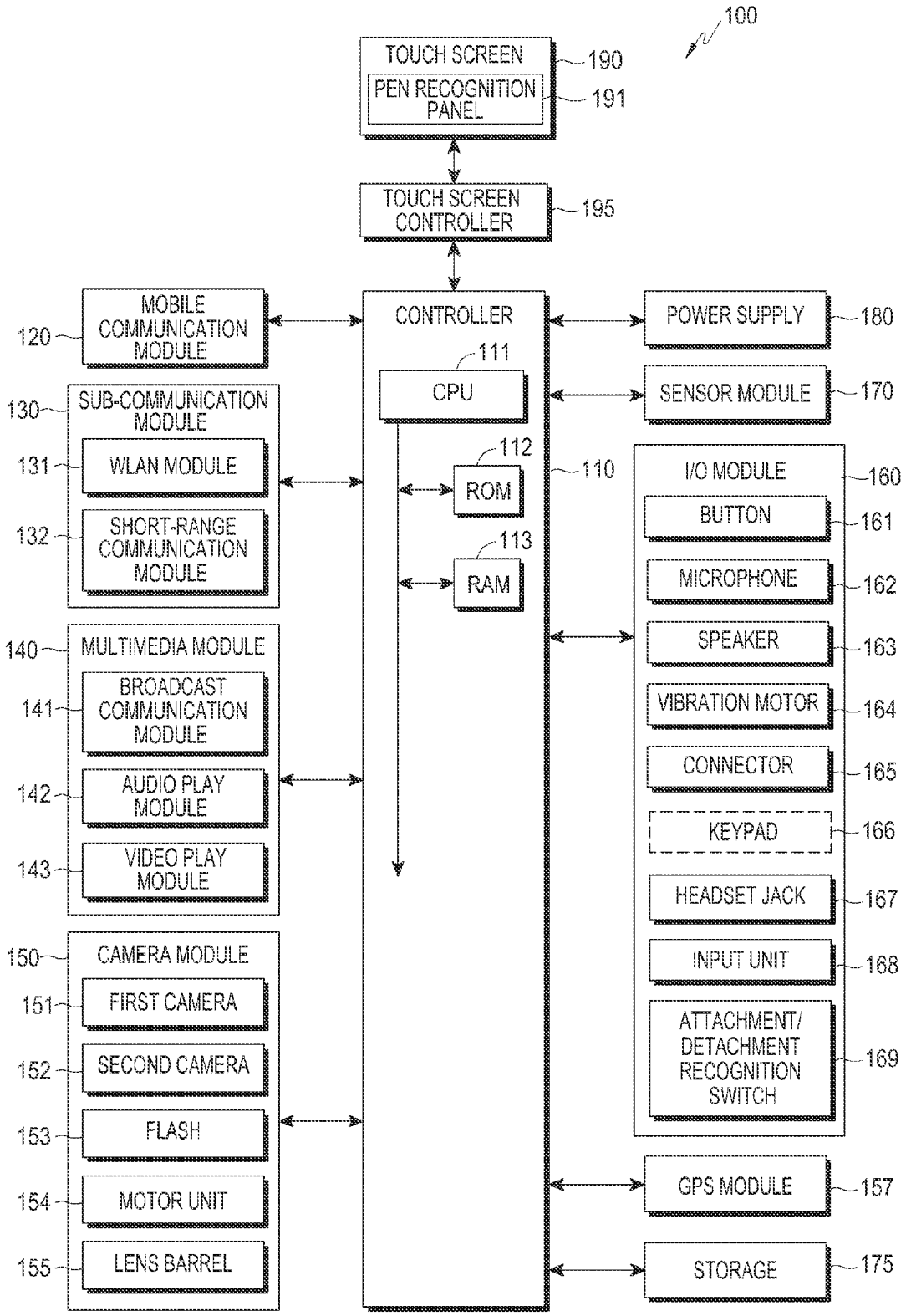
FIG. 1 is a schematic block diagram of a portable terminal that provides a haptic effect according to an embodiment of the present disclosure.

The following description with reference to the accompanying drawings is provided to assist in a comprehensive understanding of various embodiments of the present disclosure as defined by the claims and their equivalents. It includes various specific details to assist in that understanding, but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

It is to be understood that the singular forms "a," "an," and "the" include plural referents unless the context clearly dictates otherwise. Thus, for example, reference to "a component surface" includes reference to one or more of such surfaces.

By the term "substantially" it is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present disclosure.

Descriptions shall be understood as to include any and all combinations of one or more of the associated listed items when the items are described by using the conjunctive term "~ and/or ~," or the like.

The terminology used herein is for the purpose of describing particular various embodiments only and is not intended to be limiting of the disclosure. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a schematic block diagram of a portable terminal according to an embodiment of the present disclosure.

Referring to FIG. 1, a portable terminal 100 may be connected to an external device (not shown) by using at least one of a communication module 120, a sub-communication module 130, a connector 165, and a headset jack 167. The "external device" may include a variety of devices, such as earphones, external speakers, Universal Serial Bus (USB) memories, chargers, cradles/docks, Digital Multimedia Broadcasting (DMB) antennas, mobile payment related devices, health care devices (e.g., blood sugar testers), game consoles, vehicle navigations, or the like, which are removable from the portable terminal 100 and connected thereto via cable. The external device may include a Bluetooth communication device, a Near Field Communication (NFC) device, a Wi-Fi Direct communication device, and a wireless Access Point (AP). The portable terminal 100 may also be connected to other devices, such as cell phones, smartphones, tablet Personal Computers (tablet PCs), desktop PCs, or servers, wirelessly or via cable.

As shown in FIG. 1, the portable terminal 100 may further include at least one touch screen 190 and at least one touch screen controller 195. The portable terminal 100 may also include a controller 110, the mobile communication module 120, the sub-communication module 130, a multimedia module 140, a camera module 150, a Global Positioning System (GPS) module 157, an input/output module 160, a sensor module 170, a storage 175, and a power supply 180.

The sub-communication module 130 includes at least one of a Wireless Local Area Network (WLAN) 131 and a short-range communication module 132. The multimedia module 140 includes at least one of a broadcast communication module 141, an audio play module 142, and a video play module 143. The camera module 150 may include at least one of a first camera 151 and a second camera 152. The camera module 150 may include at least one of a lens barrel 155 for zooming in/out the first camera 151 and/or the second camera 152, a motor unit 154 for controlling the movement of the lens barrel 155 for zoom-in/out, and a flash 153 for providing light for shooting. The input/output module 160 may include at least one of a button 161, a microphone 162, a speaker 163, a vibrating motor 164, the connector 165, and a keypad 166.

The controller 110 may include a Central Processing Unit (CPU) 111, a Read Only Memory (ROM) 112 for storing a control program to control the portable terminal 100, and a Random Access Memory (RAM) 113 for storing signals or data input from outside or for being used as a memory space for working results in the portable terminal 100. The CPU 111 may include a single core or multiple cores (e.g., dual cores, triple cores, or quad cores). The CPU 111, ROM 112, and RAM 113 may be connected to each other via an internal bus.

The controller 110 may control the mobile communication module 120, the sub-communication module 130, the multimedia module 140, the camera module 150, the GPS module 157, the input/output module 160, the sensor module 170, the storage 175, the power supply 180, the touch screen 190, and the touch screen controller 195.

The controller 110 determines whether a hovering event occurs, i.e., whether an input unit 168, such as an electronic pen approaches any of a plurality of objects being displayed on the touch screen 190, or determines whether the input unit 168 touches the touch screen 190. The controller 110 may determine a distance from the portable terminal 100 to the input unit 168 and detect the hovering event based on the distance. The controller 110 detects a hovering event of the input unit 168 over the touch screen 190 or a touch of the input unit 168 on the touch screen 190.

The controller 110 may analyze a photo or an image captured by the camera module 150. In this regard, the controller 110 uses at least one object recognition algorithm to detect at least one object in the captured photo or image to determine the surrounding condition of the user. The object recognition algorithm, which may be, for example, corner detection, Harris corner detection, or the like, detects objects in a photo by extracting differences in color or brightness, or features of the photo. The features (or feature points) are minimum number of points left to characterize at least one object, resulting from elimination of overlapping, unimportant and unnecessary points from all the points that represent the object. Such feature points are illustrated in FIGS. 7A to 7F and may be extracted by applying various algorithms in addition to the aforementioned algorithms.

The controller 110 may determine the current surrounding condition from the captured photo using the at least one algorithm and generate a control signal to control a hearing mode of the hearing aid based on the determined surrounding condition. The control signal may include at least one of absolute sound level information, signal envelope information, spectral content information, directional microphone (mic) information. The at least one information included in the control signal are parameters to change or select a hearing mode according to the surrounding condition. The portable terminal 100 transmits the control signal to the hearing aid the user wears to control hearing mode of the hearing aid. The hearing aid analyzes the control signal received from the portable terminal 100 and then performs a mode change to a corresponding hearing mode. The controller 110 may determine the surrounding condition from surrounding sounds detected by the microphone 162, generate a control signal to control hearing mode of the hearing aid based on the surrounding condition from the surrounding sounds and the photo, and send the control signal to the hearing aid through the sub-communication module 130 or the multimedia module 140.

The mobile communication module 120 may connect the portable terminal 100 to an external electronic device through mobile communication using at least one antenna (not shown) under control of the controller 110. The mobile communication module 120 transmits/receives wireless signals for voice calls, video conference calls, Short Message Service (SMS) messages, or Multimedia Message Service (MMS) messages to/from a cell phone (not shown), a smart phone (not shown), a tablet PC (not shown), or another device not shown), the phones having phone numbers entered into the portable terminal 100.

The sub-communication module 130 may include at least one of the WLAN module 131 and the short-range communication module 132. For example, the sub-communication module 130 may include either the WLAN module 131 or the-short range communication module 132, or both.

The WLAN module 131 may be connected to the Internet via a wireless AP (not shown), under control of the controller 110. The WLAN module 131 supports Institute of Electrical and Electronic Engineers' (IEEE's) WLAN standard IEEE802.11x. The short range communication module 132 may conduct short range communication between the portable terminal 100 and an image rendering device (not shown) under control of the controller 110. The short-range communication may include Bluetooth, Infrared Data Association (IrDA), WiFi-Direct, Near Field Communication (NFC), and the like.

The controller 110 sends the control signal to control the hearing aid through the at least one of the sub-communication module 130 and the multimedia module 140.

The portable terminal 100 may include at least one of the mobile communication module 120, the WLAN module 131 and the short range communication module 132 depending on the design or function of the portable terminal 100. The portable terminal 100 may also include a combination of the mobile communication module 120, the WLAN module 131 and the short range communication module 132. In an embodiment of the present disclosure, at least one or a combination of, not exclusively, the mobile communication module 120, the WLAN module 131, and the short-range communication module 132 is referred to as a transceiver.

The multimedia module 140 may include the broadcast communication module 141, the audio play module 142, or the video play module 143. The broadcast communication module 141 may receive broadcast signals (e.g., television broadcast signals, radio broadcast signals, or data broadcast signals) and additional broadcast information (e.g., Electric Program Guide (EPG) or Electric Service Guide (ESG)) transmitted from a broadcasting station through a broadcast communication antenna (not shown), under control of the controller 110. The audio play module 142 may play digital audio files (e.g., files having extensions, such as mp3, wma, ogg, or way) stored or received under control of the controller 110. The video play module 143 may play digital video files (e.g., files having extensions, such as mpeg, mpg, mp4, avi, move, or mkv) stored or received under control of the controller 110. The video play module 143 may also play digital audio files.

The multimedia module 140 may include the audio play module 142 and the video play module 143 and may omit the broadcast communication module 141. The audio play module 142 or video play module 143 of the multimedia module 140 may be included in the controller 110.

The camera module 150 may include at least one of the first and second cameras 151 and 152 for capturing still images or video images under control of the controller 110. The camera module 150 may include at least one of a lens barrel 155 for zooming in/out to capture an object, a motor unit 154 for controlling the movement of the lens barrel 155, a flash 153 for providing auxiliary light required to capture an object. The first camera 151 may be placed on the front of the portable terminal 100 and the second camera 152 may be placed on the back of the portable terminal 100. The first and second cameras 151 and 152 may also be arranged adjacent to each other (e.g., the distance between the first and second cameras 151 and 152 may be within 1 to 8 cm), capturing 3D still images or 3D video images. The camera module 150 sends the captured photo or image to the controller 110.

The first and second cameras 151 and 152 may each include a lens system, an image sensor, and the like. The first and second cameras 151 and 152 convert optical signals input (or captured) through the lens system to electric image signals or data and sends the electric image signals or data to the controller 110, and the user may capture a video image or a still image with the first and second cameras 151 and 152.

A GPS module 157 receives radio signals from a plurality of GPS satellites (not shown) in Earth's orbit, and may calculate the position of the portable terminal 100 by using time of arrival from the GPS satellites to the portable terminal 100.

The input/output module 160 may include at least one button 161, the microphone 162, the speaker 163, the vibrating motor 164, the connector 165, the keypad 166, the headset jack 167 and the input unit 168. However, the input/output module 160 is not limited to the aforementioned elements, and may also include a mouse, a trackball, a joystick, or a cursor control such as cursor direction keys to control the movement of the cursor on the touch screen 190.

The at least one button 161 may be arranged on the front, side, or back of the housing of the portable terminal 100, and may include at least one of power/lock button (not shown), volume button (not shown), menu button, home button, back button, and search button.

The microphone 162 generates electric signals from received voice or sound under control of the controller 110. The microphone 162 also captures surrounding sounds generated around the portable terminal 100, such as concert sounds, raining sounds, crowd noise, sound of wind, meeting or speech sounds.

The speaker 163 may output sounds corresponding to various signals (e.g., radio signals, broadcast signals, digital audio files, digital video files or photography signals) from the mobile communication module 120, sub-communication module 130, multimedia module 140, or camera module 150 to the outside of the portable terminal 100 under control of the controller 110. The speaker 163 may also output a sound that corresponds to the control signal to be sent to the input unit 168 or the hearing aid through the short-range communication module 132. The sound corresponding to the control signal includes a sound of activating a vibration element 520 of the input unit 168, a sound whose volume varies depending on the intensity of vibration, and a sound of deactivating the vibration element 520. The volume of the sound may be controlled depending on the vibration intensity of the vibration element 520, or the sound may be output through the speaker 163 of the portable terminal 100 or a speaker 560 of the input unit 168 as soon as or a predetermined period of time, e.g., 10 ms before or after the vibration element 520 is activated. The sound may be stopped as soon as or a predetermined period of time, e.g., 10 ms before or after the vibration element 520 is deactivated. The speaker 163 may output sounds (e.g., button-press sounds or ringback tones) that correspond to functions performed by the portable terminal 100. One or more speakers 163 may be arranged in a proper position or proper positions of the housing of the portable terminal 100.

The vibration motor 164 may convert an electric signal to a mechanical vibration under control of the controller 110. For example, while in vibrating mode of the portable terminal 100, the vibration motor 164 works when an incoming call is received. One or more vibration motors 164 may be disposed inside the housing of the mobile terminal 100. The vibration motor 164 may be driven in response to a touch event or continuous touches of a user over the touch screen 190.

The connector 165 may be used as an interface for connecting the portable terminal 100 to the external device (not shown) or a power source (not shown). Under control of the controller 110, the portable terminal 100 may transmit data stored in the storage 175 of the portable terminal 100 to the external device or receive data from the external device via a cable connected to the connector 165. Furthermore, the portable terminal 100 may be powered by the power source or may charge the battery (not shown) with the power source via a cable connected to the connector 165.

The keypad 166 may receive key inputs from the user to control the portable terminal 100. The keypad 166 includes a mechanical keypad formed in the portable terminal 100 or a virtual keypad displayed on the touch screen 190. The mechanical keypad formed in the portable terminal 100 may be omitted depending on the performance or structure of the portable terminal 100.

A headset (not shown) may be inserted into the headset jack 167 and thus connected to the mobile device 100. The input unit 168 may be inserted and kept in the portable terminal 100 and be drawn out and detached from the portable terminal 100. An attachment/detachment recognition switch 169 operating in response to attachment and detachment of the input unit 168 is equipped in an area inside of the portable terminal 100 where the input unit 168 is inserted, and sends a signal that corresponds to the attachment or the detachment of the input unit 168 to the controller 110. The attachment/detachment recognition switch 169 is configured to have a direct or indirect contact with the input unit 168 when the input unit 168 is inserted into the area. The attachment/detachment recognition switch 169 generates the signal that corresponds to the attachment or detachment of the input unit 168 based on the direct or indirect contact and provides the signal to the controller 110.

The sensor module 170 includes at least one sensor for detecting a status of the portable terminal 100. For example, the sensor module 170 may include a proximity sensor for detecting proximity of a user to the portable terminal 100; an illumination sensor (not shown) for detecting an amount of ambient light of the portable terminal 100; a motion sensor (not shown) for detecting the motion of the portable terminal 100 (e.g., rotation of the portable terminal 100, acceleration or vibration applied to the portable terminal 100); a geomagnetic sensor (not shown) for detecting a direction using the geomagnetic field; a gravity sensor for detecting a direction of gravity action; and an altimeter for detecting an altitude by measuring atmospheric pressure. At least one sensor may detect a status of the portable terminal 100 and generate a corresponding signal to transmit to the controller 110. A sensor of the sensor module 170 may be added or removed depending on the performance of the portable terminal 100.

The storage 175 may store signals or data input/output according to operations of the mobile communication module 120, the sub-communication module 130, the multimedia module 140, the camera module 150, the GPS module 157, the input/output module 160, the sensor module 170, and the touch screen 190 under control of the controller 110.

The storage 175 may store control programs and applications for controlling the portable terminal 100 or the controller 110.

The storage 175 may also store still images and video images captured by the camera module 150. In an embodiment of the present disclosure, the storage 175 stores information regarding surrounding conditions determined from the captured images and video. The surrounding condition may be determined by extracting outlines or features (or feature points) of at least one object in the captured image or video, and may include various conditions that may exist in real life, such as a concert condition, a crowd condition, a quiet landscape condition, a class condition, a speech condition, a rainy condition or a snowy condition, a speech in quiet condition, a speech in noise condition, a windy situation, and the like. The storage 175 may also store various algorithms to determine the surrounding condition from a captured image, as described above, as well as various information used in each algorithm, which may be extracted from the image or video. The storage 175 also store features and outlines of multiple objects to determine surrounding conditions, and features and outlines of various real-life objects.

The term "storage" includes not only the storage 175, but also the ROM 112, RAM 113 in the controller 110, or a memory card (e.g., a Secure Digital (SD) card, a memory stick) installed in the portable terminal 100. The storage 175 may also include a non-volatile memory, a volatile memory, a Hard Disc Drive (HDD), or a Solid State Drive (SSD).

The storage 175 may store many different functional applications, such as navigation systems, games, time-base alarm applications, and the like, images for Graphical User Interface (GUI) associated with the applications, databases related to user information, documents, methods for handling touch inputs, background images (e.g., menu screen, standby screen, etc.) used to operate the portable terminal 100, operating programs, still images and video captured by the camera module 150, or the like. The storage 175 is a machine-readable (or computer-readable) medium, which may be defined as a medium for providing data for a machine to perform a particular function. The machine-readable medium may be a storage medium. The storage 175 may include non-volatile and volatile media. These media should be all tangible for a mechanical device to read out instructions embodied on the media.

The machine-readable media includes, but not exclusively, at least one of floppy disks, flexible disks, hard disc, magnetic tapes, Compact Disc Read-Only Memories (CD-ROMs), optical discs, punch cards, paper tapes, RAMs, Programmable ROMs (PROM), Erasable PROMs (EPROMs), and flash-EPROMs.

The power supply 180 may supply power to one or more batteries (not shown) placed inside the housing of the portable terminal 100, under control of the controller 110. The one or more batteries power the portable terminal 100. The power supply 180 may supply the portable terminal 100 with the power input from the external power source (not shown) via a cable connected to the connector 165. The power supply 180 may also supply the portable terminal 100 with wireless power from an external power source using a wireless charging technology.

The portable terminal 100 may have at least one touch screen to provide GUIs for various services (e.g., call, data communication, broadcasting, photography and the like). Each of the at least one touchscreen may send an analog signal corresponding to at least one touch input to the user interface to the touchscreen controller 195. The portable terminal 100 may have multiple touch screens and corresponding multiple touch screen controllers, each of which receives an analog signal generated according to a touch on the corresponding touch screen. The at least one touch screen may be connected to a plurality of housings with hinges, or may be placed in a single housing without hinges. In the present disclosure, for convenience of explanation, an embodiment where the portable terminal 100 has a single touch screen e.g., the touch screen 190 will be described.

The touch screen 190 may receive at least one touch from the user's physical contact (e.g., with fingers including thumb) or via a touchable input unit 168 (e.g., a stylus pen or an electronic pen). The touch screen 190 includes a pen recognition panel 191 to recognize an input of the input unit 168. The pen recognition panel 191 may estimate a distance between the touch screen 190 and the input unit 168 by using a magnetic field. The touch screen 190 may receive consecutive moves of one of the at least one touch. The touch screen 190 may send an analog signal corresponding to the consecutive moves of the input touch to the touchscreen controller 195.

The term 'touch' as used herein may be construed to include not only the contact touch but also contactless touch (e.g., keeping a detectable distance less than 1 mm) between the touch screen 190 and the user's body or the touch input unit. The detectable distance from the touchscreen 190 may vary depending on the performance or structure of the portable terminal 100, and in particular, the touchscreen 190 may output different values (e.g., analog current values) for touch detection and hovering detection to distinguishably detect a touch event occurred by a contact with the user's body or the touch input unit and a contactless input (e.g., a hovering event). Furthermore, the touch screen 190 may output different values (e.g., current values) for hovering detection over distance between where the hovering event occurs and the touch screen 190.

The touch screen 190 may be implemented in, for example, a resistive manner, a capacitive manner, an infrared manner, or an acoustic wave manner.

The touch screen 190 may include at least two touch screen panels for detecting touches or proximity of the user's body or the touch input unit to receive inputs of the user's body and the touch input unit simultaneously or sequentially. The at least two touchscreen panels provide different output values to the touch screen controller 195, and the touch screen controller 195 may differentiate inputs made by the user's body and inputs made by the touch input unit on the touch screen 190 by differently recognizing the values input from the at least two touch screen panels.

The touch screen 190 may be formed in a layered structure in which a panel to detect an input made by the user's finger or the input unit 168 based on a change in induced electromotive force and a panel to detect a contact of the user's finger or the input unit 168 with the touch screen 190 are close to each other or partly kept at a distance from each other. The touch screen 190 includes a large number of pixels to display an image. The touch screen 190 may use Liquid Crystal Displays (LCDs), Organic Light Emitting Diodes (OLEDs), Light Emitting Diodes (LEDs), and the like.

The touch screen controller 195 may determine the distance between where the hovering event occurs and the touch screen 190 by detecting a value (e.g., a current value) output through the touch screen 190, convert the determined distance to a digital signal (e.g., in Z coordinate), and provide the digital signal to the controller 110.

Figure 2:
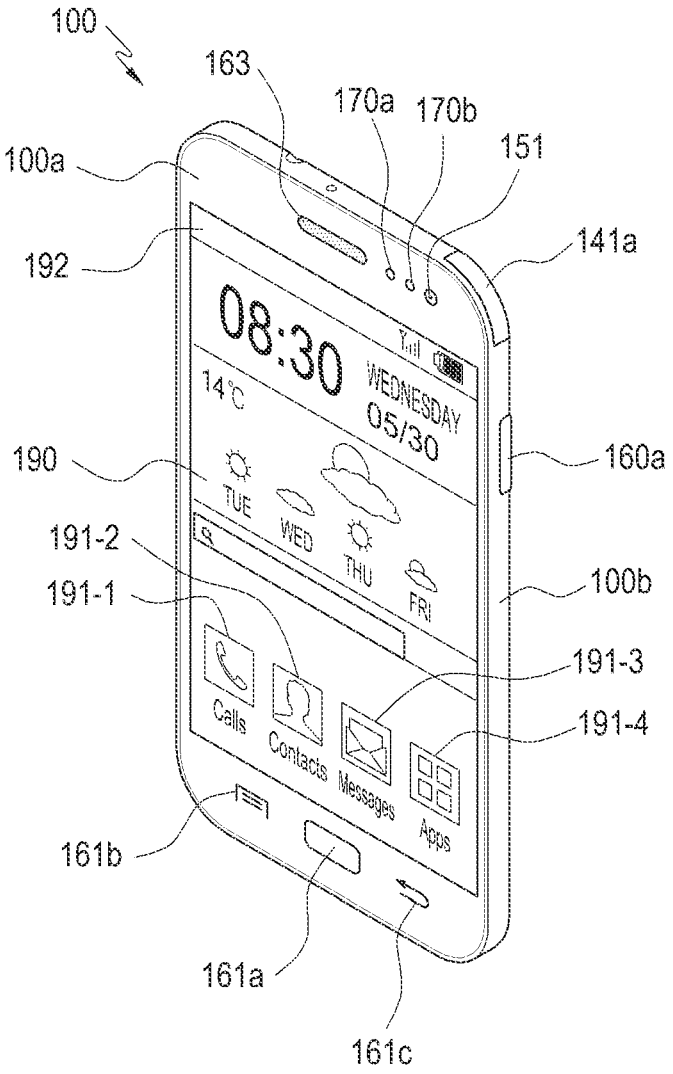
FIG. 2 is a perspective view of the front face of a portable terminal according to an embodiment of the present disclosure.
Figure 3:
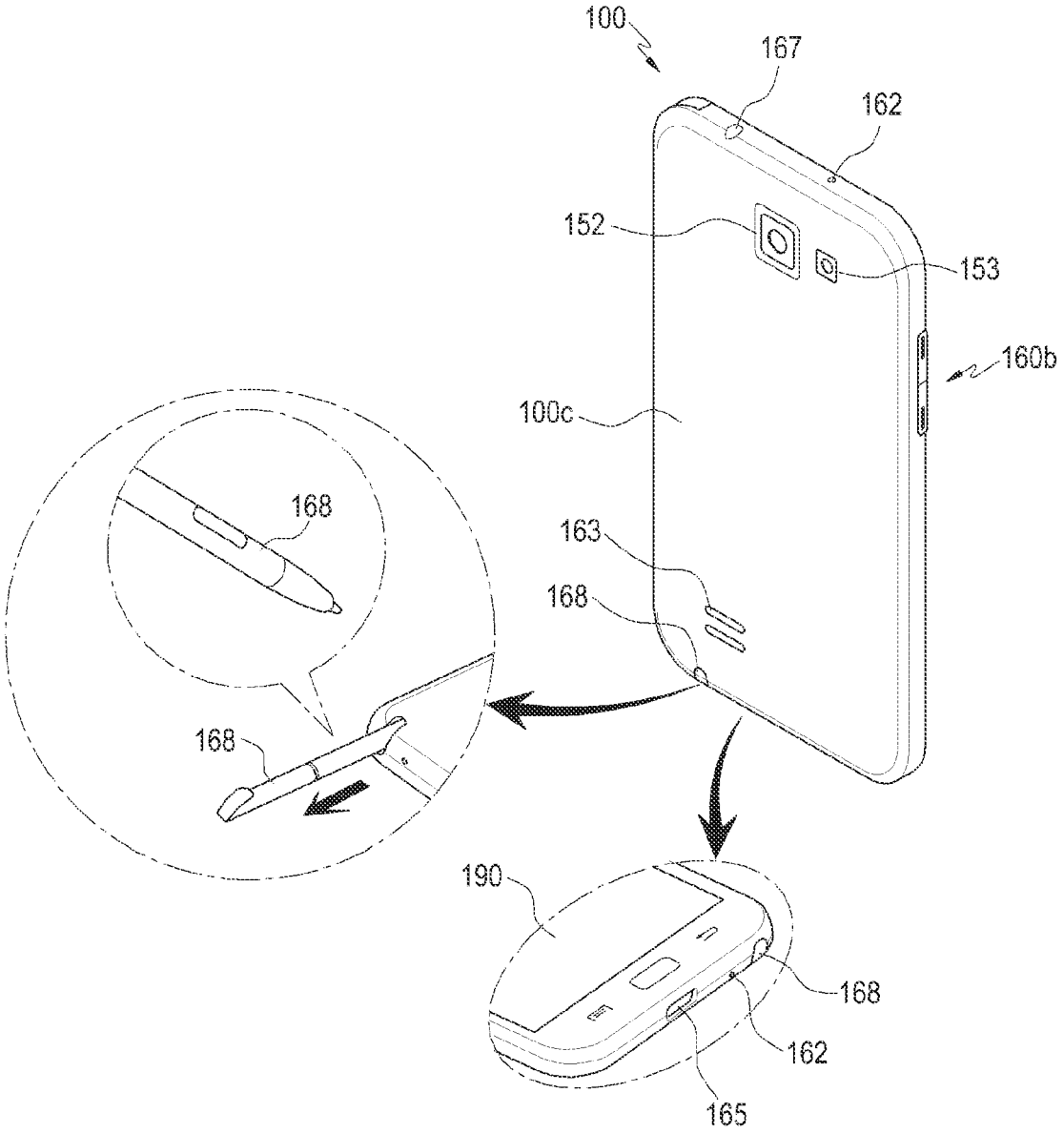
FIG. 3 is a perspective view of the back face of a portable terminal according to an embodiment of the present disclosure.

FIG. 2 is a perspective view of the front face of a portable terminal according to an embodiment of the present disclosure, and FIG. 3 is a perspective view of the back face of a portable terminal according to an embodiment of the present disclosure.

Referring to FIGS. 2 and 3, the touch screen 190 is arranged in the middle of the front face 100*a* of the portable terminal 100. The touch screen 190 may take up a major portion of the front face 100*a* of the portable terminal 100. In FIG. 2, the touch screen 190 displays a main home screen. The main home screen is a first screen to be displayed on the touch screen 190 when the portable terminal 100 is powered on. When the portable terminal 100 has several pages of different home screens, the main home screen may be the first of several pages of home screens. Shortcut icons 191-1, 191-2, 191-3 for running frequently-used applications, a main menu key (or an apps key) 191-4, a time indicator, a weather indicator, and the like may be displayed in the main home screen. If selected, the main menu key 191-4 displays a menu screen on the touchscreen 190. In an upper part of the touchscreen 190, a status bar 192 may be shown, in which statuses of the portable terminal 100 are displayed, such as a battery charging state, intensity of received signals, current time, and the like.

A home button 161*a*, a menu button 161*b*, and a back button 161*c* may be arranged in a lower part of the touch screen 190. The home button 161*a* is to display the main home screen on the touch screen 190. For example, if the home button 161*a* is touched while any home screen other than the main home screen or a menu screen is displayed in the touch screen 190, the main home screen may be displayed on the touch screen 190. Furthermore, while applications are running on the touch screen 190, if the home button 161*a* is touched, the main home screen, as shown in FIG. 2, may be displayed on the touch screen 190. The home button 161*a* may also be used to display recently used applications or a task manager on the touch screen 190.

The menu button 161*b* provides a link menu that may be used on the touch screen 190. The link menu may include a widget addition menu, background change menu, search menu, edit menu, environment setting menu, and the like.

The back button 161*c*, when touched, may display a screen that was displayed right before the current screen or stop a most recently used application.

The first camera 151, the illumination sensor 170*a*, and the proximity sensor 170*b* may be placed on the edge of the front face 100*a* of the portable terminal 100. The second camera 152, the flash 153, and the speaker 163 may be placed on the back face 100*c* of the portable terminal 100.

A power/reset button 160*a*, a volume button 160*b*, a terrestrial DMB antenna 141*a* for broadcast reception, one or more microphones 162, and the like may be placed on the side 100*b* of the portable terminal 100. The DMB antenna 141*a* may be fixed to the portable terminal 100, or be detachably arranged.

The connector 165 is formed on the lower side of the portable terminal 100. The connector 165 has a number of electrodes and may be connected to an external device via a cable. The headset jack 167 may be formed on the upper side of the portable terminal 100. The headset jack 167 may receive a headset.

The input unit 168 may be disposed on the lower side of the portable terminal 100. The input unit 168 may be inserted and kept inside of the portable terminal 100 and be drawn out and detached from the portable terminal 100 for use.

Figure 4:
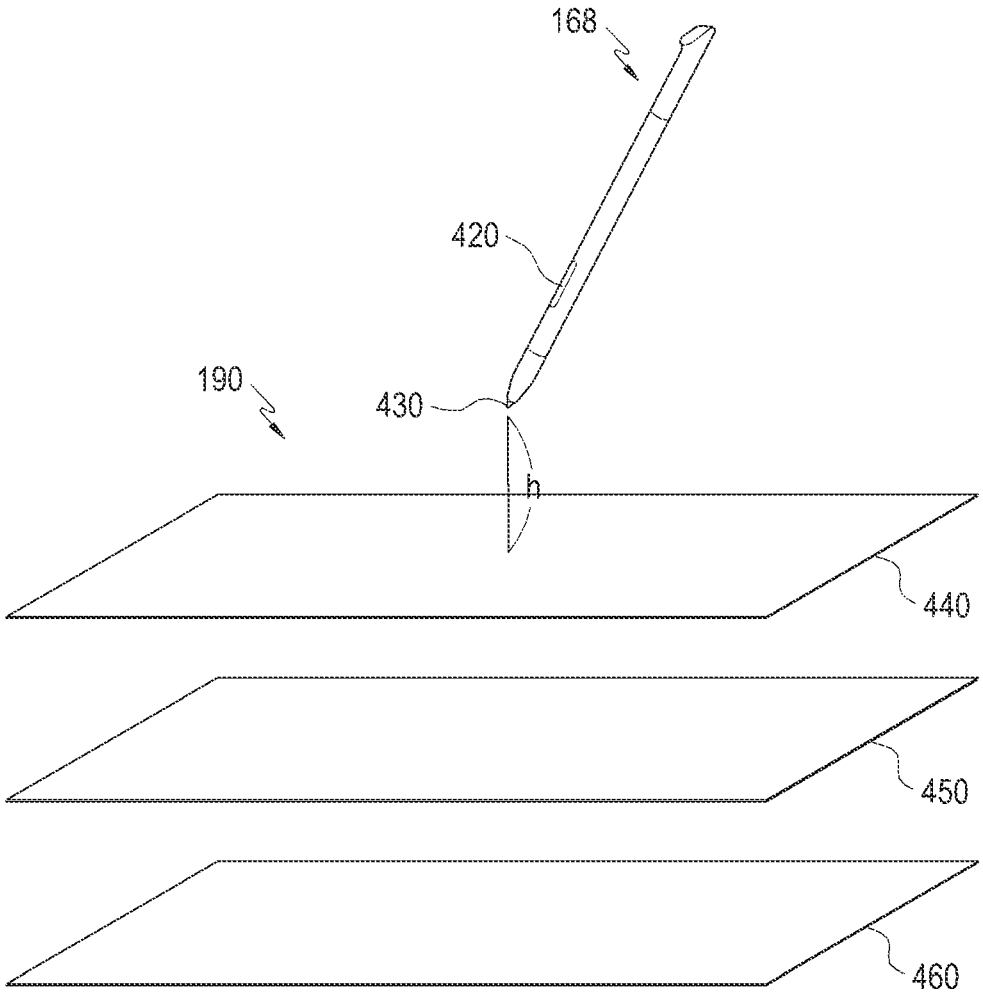
FIG. 4 illustrates an input unit and a sectional view of a touch screen according to an embodiment of the present disclosure.

FIG. 4 illustrates an input unit and a touch screen in section according to an embodiment of the present disclosure.

Referring to FIG. 4, the touch screen 190 includes a display panel 440, a first touch panel 450, and a second touch panel 460. The display panel 440 may be an LCD panel, an Active Matrix Organic Light Emitting Diodes (AMOLED) panel, and the like, displaying various operating states of the portable terminal 100, various images resulting from applications and services, and a plurality of objects.

The first touch panel 450 is a capacitive touch panel obtained by coating both sides of a glass with a metal conductive material, e.g., Indium Tin Oxide (ITO) film to conduct a current on the surface of the glass, which is coated again with a dielectric substance to hold charges. Upon a touch of an input unit, e.g., the user's finger or a pen on the surface of the first touch panel, a certain amount of charge moves to the location of the touch due to static electricity. The first touch panel 450 detects the location of the touch by recognizing a change in current due to the movement of the certain amount of charges. Many different kinds of touches that may induce static electricity may be detected on the first touch panel 450. The touches may be made by any type of input unit, such as fingers and pens.

The second touch panel is an Electronic Magnetic Resonance (EMR) touch panel, including an electromagnetic inductive coil sensor (not shown) having a grid structure in which a plurality of loop coils are arranged in a predetermined first direction and a second direction intersecting the first direction, and an electronic signal processor (not shown) for sequentially providing an alternate current (AC) signal with a predetermined frequency to the loop coils of the electromagnetic inductive coil sensor. If the input unit 168 having a resonant circuit approaches the second touch panel, a magnetic field generated from the corresponding loop coil induces a current in the resonant circuit of the input unit 168 based on mutual electromagnetic induction. Based on the current, an inductive magnetic field is generated from a coil (not shown) of the resonant circuit of the input unit 168. The portable terminal 100 may detect a hovering position, a touch position of the input unit 168, and a height (h) from the display panel 440 to the tip 430 of the input unit 168 by detecting the inductive magnetic field from the loop coil in a receiving state. The height (h) from the display panel 440 to the tip 430 of the input unit 168 may vary depending on the performance or structure of the portable terminal 100.

Hovering and touch events made by any input unit that may induce a current based on electromagnetic induction may be detected on the second touch panel 460. In various embodiments of the present disclosure, the second touch panel 460 is dedicated to detect the hovering or touch event by the input unit 168. The input unit 168 may also be referred to as an electromagnetic pen or an EMR pen. The input unit 168 may be different from typical pens that do not have resonant circuits nor are detected by the first touch panel 450. The input unit 168 may be configured to have a button 420 to change electromagnetic induction values generated by a coil placed inside of the body of the input unit 168 and adjacent to the tip 430 of the body. The input unit 168 is described below with respect to FIG. 5.

The touch controller 195 may include a first touch panel controller and a second touch panel controller. The first touch panel controller converts an analog signal received from the first touch panel 450 upon detection of the user's finger or pen touch to a digital signal (e.g., in X, Y, and Z coordinates) and sends the digital signal to the controller 110. The second touch panel controller converts an analog signal received from the second touch panel 460 upon detection of hovering or touch of the input unit 168 to a digital signal and sends the digital signal to the controller 110. The controller 110 uses the digital signal received from each of the first and second touch panel controllers to control the display panel 440, the first touch panel 450 or the second touch panel 46. For example, the controller 110 may display a screen in a predetermined form on the display panel 440 in response to the hovering or touch of the finger, the pen, or the input unit 168.

In an embodiment of the portable terminal 100, the first touch panel may detect a touch of the user's finger or a pen while the second touch panel may detect hovering or touches by the input unit 168. The controller 110 of the portable terminal 100 may thus discriminate detect hovering or touches by the user's finger or pen from hovering or touches by the input unit 168. Although only one touch screen is illustrated in FIG. 4, various embodiments of the present disclosure are not limited only to one touch screen but may include a plurality of touch screens. Each touch screen is included in a respective housing by being connected thereto with a hinge or a plurality of touch screens may be included in a single housing. Each of the plurality of touch screens is configured to have a display panel and at least one touch panel, as shown in FIG. 4.

Figure 5:
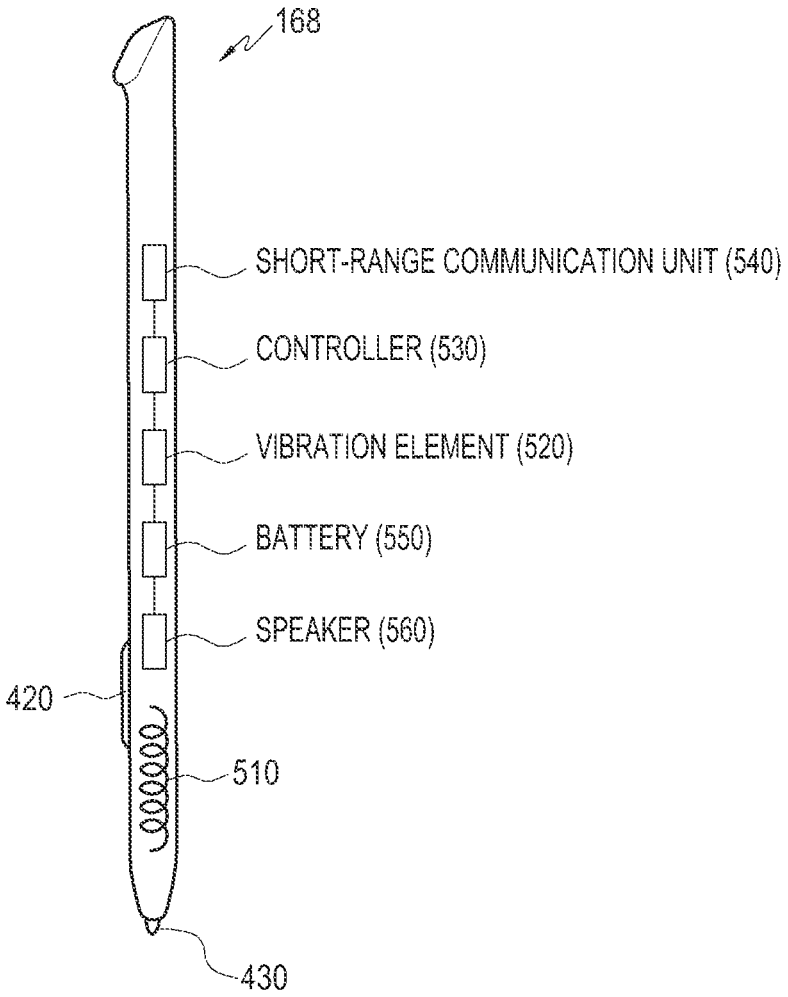
FIG. 5 is a block diagram of an input unit that provides a haptic effect according to an embodiment of the present disclosure.

FIG. 5 is a block diagram of an input unit that provides a haptic effect according to an embodiment of the present disclosure.

Referring to FIG. 5, in an embodiment of the present disclosure, the input unit 168, (e.g., a touch pen) may have a body in a pen shape with a pen point 430 on the tip of the body. Inside the body, the input unit 168 may include a coil 510 adjacent to the pen point 430, a vibration element 520 that vibrates when an hovering effect occurs, a controller 530 that analyzes a control signal received from the portable terminal 100 due to the hovering event and controls vibrating intensity and vibration interval of the vibration element 520, a short-range communication unit 540 that performs short-range communication with the portable terminal 100, and a battery 550 for supplying power for vibration of the input unit 168. The input unit 168 may also include a button 420 to change electromagnetic induction values generated by the coil 510. The input unit 168 may also include a speaker 560 to output a sound according to the vibration interval and/or the vibrating intensity of the input unit 168.

The speaker 560 may output sounds that correspond to various signals (e.g., radio signals, broadcast signals, digital audio files, or digital video files) from the mobile communication module 120, sub-communication module 130, or multimedia module 140 under control of the controller 530. The speaker 560 may also output sounds that correspond to functions performed by the portable terminal 100 (e.g., button press sounds or ringback tones). One or more speakers may be formed in a proper position or positions in the housing of the input unit 168.

If the pen point 430 contacts the touch screen 190 of the portable terminal 100 or approaches within a detectable distance of hovering (e.g., 5 mm), the controller 530 analyzes at least one control signal received from the portable terminal 100 through the short-range communication unit 540 and controls vibrating intensity, vibration intervals, and the like of the vibration element 520 under the analyzed control signal. The control signal may or may not be equal to a control signal that the portable terminal 100 sent to the hearing aid, and the input unit 168 may output the same sound as the sound output from the hearing aid, under control of the controller 530. A method of controlling hearing mode of a hearing aid according to an embodiment of the present disclosure is described below with respect to FIGS. 6, 7A, 7B, 7C, 7D, 7E, and 7F.

Figure 6:
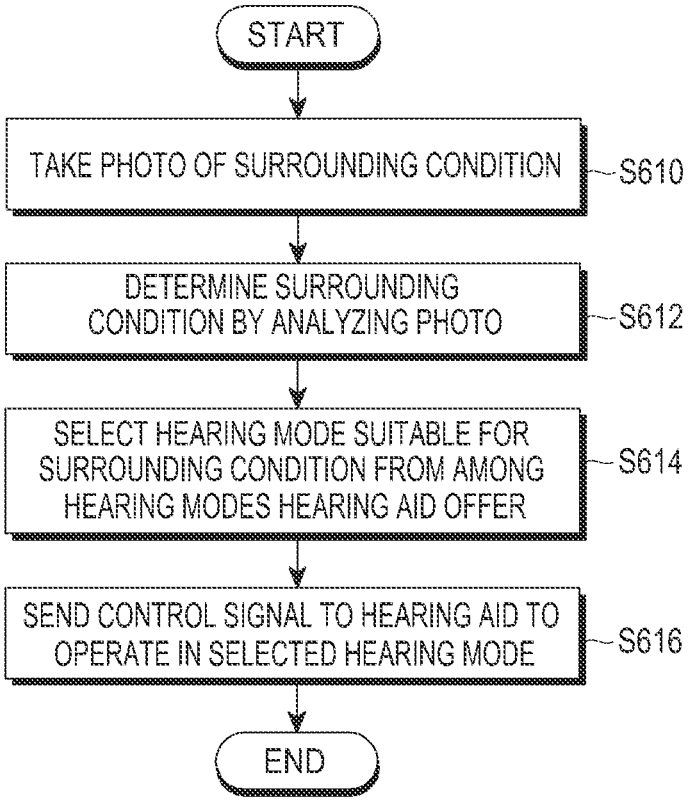
FIG. 6 is a flowchart illustrating a method for controlling hearing mode of a hearing aid with a portable terminal according to an embodiment of the present disclosure.

FIG. 6 is a flowchart illustrating a method for controlling a hearing aid with a portable terminal according to an embodiment of the present disclosure, and FIGS. 7A, 7B, 7C, 7D, 7E, and 7F illustrates photos containing surrounding conditions to be used to adaptively select hearing mode of a hearing aid according to an embodiment of the present disclosure.

Referring to FIG. 6 and FIGS. 7A-7F, in an attempt to change or select a hearing mode of a hearing aid by taking into account a surrounding condition, a portable terminal 100 may take a photo of the surrounding condition of the user with a camera module 150 of the portable terminal, in operation S610. The surrounding conditions may include weather conditions, (e.g., whether it rains or snows), landscapes such as mountains, sea, or fields, or some situations such as meetings or concerts. The surrounding conditions may include other various situations, such as a speech in quiet conditions, a speech in noisy conditions, a windy condition, and the like. The portable terminal 100 runs a hearing aid control application in advance to change or select a hearing mode of the hearing aid.

Figure 7A:
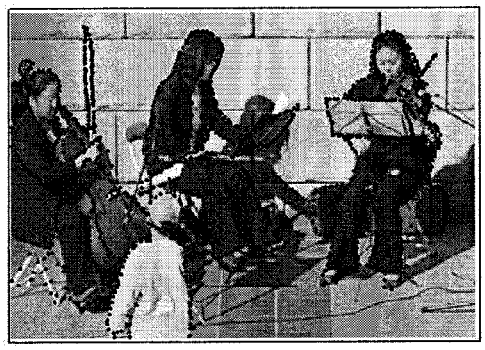
FIGS. 7A, 7B, 7C, 7D, 7E, and 7F illustrate photos containing surrounding conditions to be used to select a proper hearing mode of a hearing aid according to an embodiment of the present disclosure.
Figure 7B:
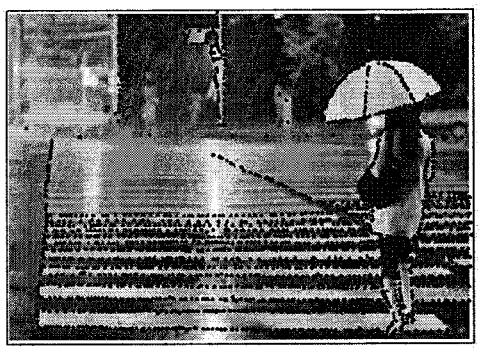

The hearing aid control application controls photo shooting, analysis of the photo, volume of the hearing aid, threshold settings based on the analysis of the photo, and multiple hearing modes. The application may be downloaded from a server that provides multiple applications or may be provided in environment settings of the portable terminal 100. At least one function provided by the application may be automatically or manually set up based on analysis of a surrounding condition. The hearing mode may also be newly added or removed based on the surrounding condition obtained from the captured photo. The hearing aid has multiple hearing modes that correspond to respective surrounding conditions of the user's current location. For example, as shown in FIGS. 7A to 7F, surrounding conditions may include a concert condition (as shown in FIG. 7A), a rainy condition (FIG. 7B), a crowd condition (FIG. 7C), a landscape condition (FIG. 7D), a meeting condition (FIG. 7E), and a class condition (FIG. 7F). The surrounding conditions are not limited thereto but may include other various surroundings of the user.

Figure 7C:
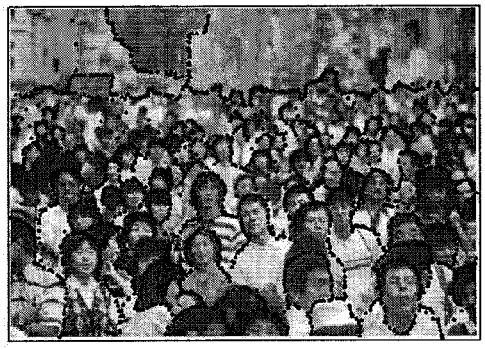
Figure 7D:
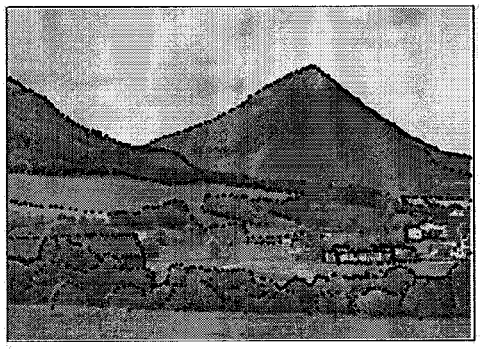

If the surrounding condition appears to be quiet as shown in FIG. 7D, the volume of the output sound of the hearing aid may be turned down to enable the user wearing the hearing aid to hear surrounding sounds with low output power of the hearing aid, and if the surrounding condition appears to be noisy as shown in FIG. 7C, the volume of the output sound of the hearing aid may be turned up to help the user wearing the hearing aid hear surrounding sounds well.

The controller 110 analyzes the photo captured in operation S610 to determine the surrounding condition in operation S612. The photo may have been stored in the storage 175 under control of the controller 110. Based on the photo, the controller 110 determines the surrounding condition of the user. Generally, the photo contains at least one object like people, mountains, musical instruments, and the like, which may be detected by the controller 110 using colors, brightness, features, etc. of the photo. At least one object recognition algorithm may be used to detect the object. The object recognition algorithm includes corner detection (e.g., Harris corner detection), and various embodiments of the present disclosure are not limited thereto, but may also include other various algorithms to detect at least one object by extracting features of a photo captured. The controller 110 determines whether the same features of the detected object has been found from among multiple features stored beforehand.

Information about features of multiple objects may be stored in the storage 175. The information about features may include different information about, for example, colors to distinguish objects according to the type of the object, and may enable at least one object to be detected by forming features along the contour of the object in the photo captured as shown in FIGS. 7A to 7F. The controller 110 analyzes the object included in the photo and determines the surrounding condition by comparing the result of analyzing the at least one object and objects stored beforehand.

The features refer to points which are formed along the contour of the at least one object based on at least one of brightness and color to distinguish the size and type of the object. an object may have multiple features, and the object may be identified with a shape formed by the features. The features (or feature points) are a minimum number of points left to characterize at least one object, resulting from elimination of overlapping, unimportant and unnecessary points from all the points that represent the object. Examples of the features are shown in FIGS. 7A, 7B, 7C, 7D, 7E, and 7F, and many different algorithms may be applied to detect objects in photos.

The controller 110 may determine a surrounding condition from the captured photo using at least one algorithm and generate a control signal to control hearing mode of the hearing aid based on the surrounding condition. The control signal may include at least one of absolute sound level information, signal envelope information, spectral content information, and directional microphone information. The information included in the control signal are parameters to change or select a hearing mode according to the surrounding condition. The information is used to classify hearing environments into proper modes. The absolute sound level information indicates a standard reference sound level; the signal envelope information indicates an envelope of a detected sound signal; the spectral content information indicates what resulted from frequency analysis of a detected signal; and the directional microphone information indicates beamforming information for identifying a sound originated from a particular thing or person from among various detected sounds. In various embodiments of the present disclosure, the parameters are used to determine the surrounding condition. In an embodiment, the control signal includes at least one parameter to be adjusted according to respective hearing modes. The parameter may include feedback canceler, noise reduction, wide dynamic range compression (WDRC), adaptive directional mic etc.

The feedback canceler cancels feedback generated due to amplified sound from the hearing aid. For example, if the user wearing the hearing aid holds the cell phone close to the user's ear or the user is walking close to a wall, feedback is generated. The sound amplified by the hearing aid is passed through an external auditory canal of the user's ear back to a microphone, which generates feedback. The feedback may be adjusted by adjusting the feedback canceler parameter, which may be set in all conditions but a concert condition. The noise reduction parameter is used to eliminate or reduce noise generated in a surrounding condition, and may be automatically set based on estimation of surrounding noise. For example, the noise reduction parameter is set to 0 dB for a concert condition, and 12 dB for a windy condition. The WDRC parameter provides a great gain for small sounds coming from outside while providing a small gain for loud sounds, thereby enabling the user wearing the hearing aid to hear a wide range of sounds well. The WDRC parameter may be set as a multi-band level detector in all conditions but a concert condition and as a multi-band level detector plus wide-band level detector in the concert condition. The adaptive directional microphone parameter is used to adjust a direction of the microphone to capture a sound based on the surrounding condition, and may be set in all conditions but the concert condition and the windy condition.

For example, if a hearing mode for a surrounding condition is one of silent, speech, class, noise, and crowd modes, the feedback canceler parameter may be set to 'normal'; the noise reduction parameter may be set to an adaptive noise reduction level; the WDRC parameter may be set to multiple bands; and the adaptive directional microphone may be set to 'adaptive'. If a hearing mode for a surrounding condition is concert or music mode, the feedback canceler parameter may be set to 'slow'; the noise reduction may be set to 'inactive'; the WDRC parameter may be set to a combination of multiple bands and wide band; and the adaptive directional microphone may be set to 'omnidirectional'. If a hearing mode for a surrounding condition is landscape mode in a windy condition, the feedback canceler parameter may be set to 'normal'; the noise reduction parameter may be set to 12 dB; the WDRC parameter may be set to multiple bands; and the adaptive directional microphone may be set to 'omnidirectional'.

The controller 110 may select one of the hearing modes the hearing aid may offer based on the determined surrounding condition, in operation S614. In various embodiments of the present disclosure, the hearing aid provides multiple hearing modes which may be automatically or manually changed according to respective surrounding conditions. The hearing aid may periodically or randomly transmit or receive signals to or from the portable terminal 100. The portable terminal 100 may be informed of types of hearing mode the hearing aid may offer and a current hearing mode through signals communicated with the hearing aid. The types of hearing mode are stored in the storage 175 and refreshed periodically. The types of hearing mode may be displayed through a dedicated application for controlling a hearing mode of the hearing aid, and may be changed, selected, removed, refreshed, or generated by the user. In an embodiment of the present disclosure, the hearing mode may be selected using the photo captured in operation S610 or selected using a result of matching the captured photo and surrounding sounds detected from the microphone 162 of the portable terminal 100.

The surrounding sounds may originate from any object of the captured photo, and in an embodiment of the present disclosure, the controller 110 determines whether a surrounding condition obtained by determining whether the captured photo corresponds to a surrounding condition obtained by analyzing the detected surrounding sound in order to select a hearing mode. If the surrounding condition from the captured photo and the surrounding condition from the detected surrounding sound match, the controller 110 selects a hearing mode suitable for the surrounding condition. If the surrounding condition from the captured photo and the surrounding condition from the detected surrounding sound do not match, the user should take a picture around the user again or detect a surrounding sound again to determine whether there is a match. If the hearing mode for the surrounding condition is not provided by the corresponding application, the application may newly generate the hearing mode that corresponds to the surrounding condition.

The controller 110 sends the hearing aid a control signal to operate the hearing aid in the selected hearing mode, in operation S616. The control signal is generated taking into account a case where the hearing mode is selected based on a captured photo or a case where the hearing mode is selected by matching the captured photo and the surrounding sound. The control signal is a signal to select a proper hearing mode suitable for a surrounding condition from among various hearing modes the hearing aid may offer, which is generated based on the determined surrounding condition and the surrounding sound detected by the portable terminal 100. The control signal may include a control signal to control a hearing mode of the hearing aid by analyzing the surrounding condition from a photo captured by the portable terminal 100, and a control signal to control hearing mode of the hearing aid to analyze the surrounding sound detected by the portable terminal 100. The portable terminal 100 controls hearing mode of the hearing aid by sending the control signal to the hearing aid.

Figure 8:
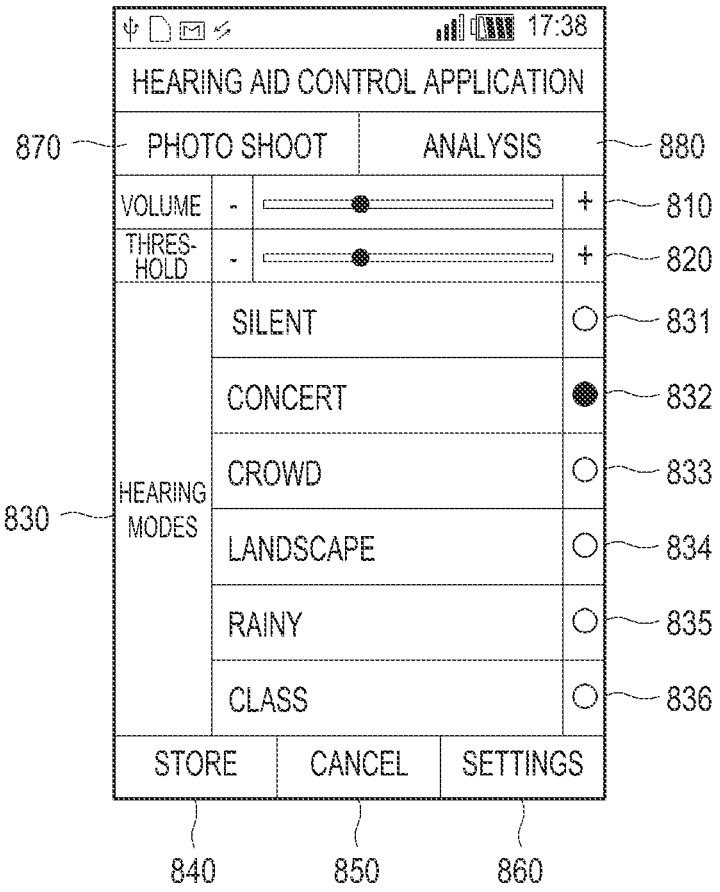
FIG. 8 illustrates a screen of a hearing aid control application to control hearing mode of a hearing aid according to an embodiment of the present disclosure.

FIG. 8 illustrates a screen of a hearing aid control application for controlling hearing mode of a hearing aid according to an embodiment of the present disclosure.

Referring to FIG. 8, to control hearing mode of a hearing aid, the user may run a hearing aid control application stored in the storage 175 or manipulate an environment settings menu. The hearing aid control application includes at least one of a photo shoot menu 870 to take a photo, an analysis menu 880 to analyze a captured photo, a volume menu 810 to control the volume of the hearing aid, a threshold menu 820 to adjust thresholds to be set for analysis of a captured photo, a hearing mode menu 830 to select a proper hearing mode suitable for a surrounding condition, a store menu 840, a cancel menu 850, and a setting menu 860. The hearing mode menu 830 may provide various hearing modes, such as silent mode 831, concert mode 832, crowd mode 833, landscape mode 834, rainy mode 835, and class mode 836. Also, the hearing mode menu 830 may include at least one of silent mode, concert mode, crowd mode, landscape mode, rainy mode, and class mode. Each of the hearing modes may be used to amplify sounds for output in the hearing aid.

If the photo shoot menu 870 is selected, the camera module 150 is activated and ready to take a photo. If a photo is captured, the photo is displayed on the touch screen 190 of the portable terminal 100, and upon selection of the analysis menu 800, analyzed to determine the surrounding condition.

If the analysis menu 880 is selected, at least one algorithm to analyze at least one object in the photo is applied and thus at least one object is figured out. After completion of the analysis, the result is displayed for the user to determine whether the analysis result is correct. After the user makes a confirmation or the analysis is complete, a hearing mode provided by the hearing mode menu that corresponds to the analysis result is activated. Alternatively, the user may manually select a hearing mode based on the displayed analysis result. In FIG. 8, a concert mode 832 is shown to be selected.

The store menu 840 is selected to store selections or designations of the volume, threshold, and hearing mode and the analysis results of the captured photo. After those selections or designations and the analysis results are stored by selecting the store menu 840, a control signal reflecting the selections or designations and the analysis results is generated under control of the controller 110 and sent to the hearing aid. The user may select the setting menu 860 to modify or change the hearing mode or the analysis results.

Figure 7E:
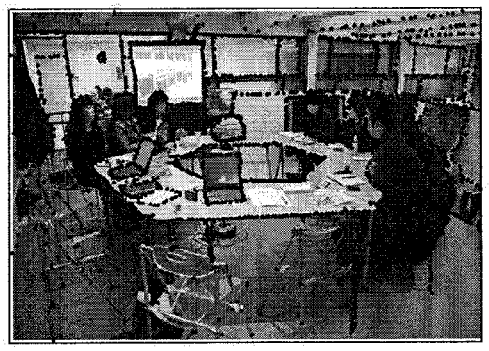
Figure 7F:
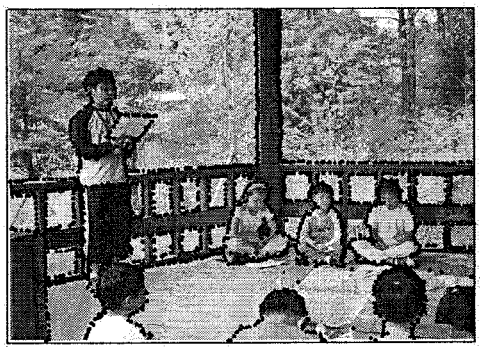

The silent mode 831 deactivates the hearing function of the hearing aid. When the silent mode 831 is selected, the hearing function of the hearing aid is stopped. The concert mode 832 may be selected for better quality hearing in a condition where musical instruments are being played around the user wearing the hearing aid, as shown in FIG. 7A. The crowd mode 833 may be selected for better quality hearing in a condition where many people are around the user wearing the hearing aid, as shown in FIG. 7C. The landscape mode 833 may be selected to sensitively detect small surrounding sounds in a condition where the surroundings of the user wearing the hearing aid is relatively quiet, as shown in FIG. 7D. The rainy mode 835 may be selected for better quality hearing in a rainy condition, as shown in FIG. 7B. A meeting mode (not shown) or the class mode 836 is selected for better quality hearing in a condition where a single person or a few people are talking, as shown in FIGS. 7E and 7F, respectively.

Figure 9:
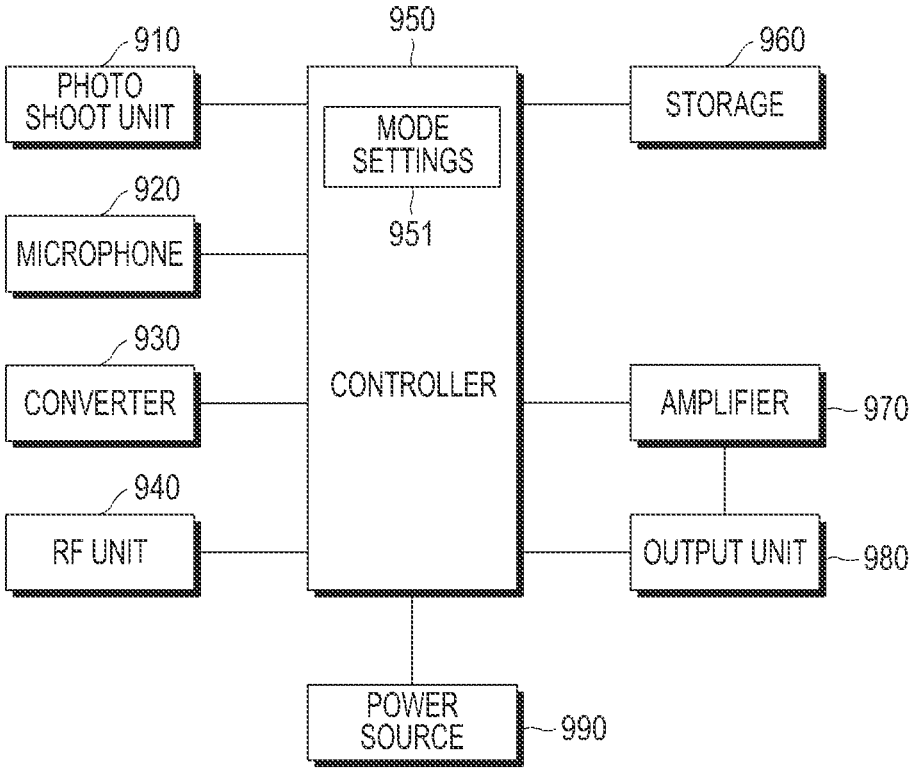
FIG. 9 is a block diagram of a hearing aid whose hearing mode is controlled according to an embodiment of the present disclosure.

FIG. 9 is a block diagram of a hearing aid whose hearing mode is controlled according to an embodiment of the present disclosure.

Referring to FIG. 9, a hearing aid may include a photo shoot unit 910 for taking photos, a microphone 920 for detecting surrounding sounds, a converter 930 for converting a detected surrounding sound in an analog form to a digital signal, a Radio Frequency (RF) unit 940 for receiving control signals from the portable terminal 100, a storage 960 for storing a captured photo and results of analyzing the captured photo, an amplifier 970 for amplifying a voice signal in a selected hearing mode, an output unit 980 for outputting the amplified voice signal, a power source 990 for supplying power, and a controller 950 for controlling general operations of the hearing aid, analyzing the surrounding condition from the captured photo, and controlling the hearing mode of the hearing aid.

The microphone 920 is placed on the outside of the hearing aid that the user wears on the user's ear. The microphone 920 receives analog signals around the ear and passes the analog signals to the converter 930 under control of the controller 950. The converter 930 includes an analog-to-digital converter module and a digital-to-analog converter module. The converter 930 converts the analog signal passed from the microphone 920 to a digital signal and sends the digital signal to the controller 950. The controller 950 performs digital processing, such as cancellation of unnecessary noise, feedback control, control of the amplification gain of the amplifier 970, nonlinear amplification, and the like, on the digital signal received from the converter 930 and sends the result back to the converter 930. The controller 950 also sends types of hearing modes of the hearing aid to the portable terminal 100 through the RF unit 940. Upon reception of the control signal to control the hearing mode of the hearing aid from the portable terminal 100, the controller 950 controls the hearing mode (e.g., changes, cancels, or deletes the hearing mode) by the mode setting module 851 analyzing the control signal received from the portable terminal 100. The control signal may include not only the types of hearing mode but also information used to establish an amplification gain for each frequency based on the surrounding condition, which may be periodically or randomly communicated from the portable terminal 100.

The controller 950 may also determine the current surrounding condition by analyzing a photo captured by the photo shoot unit 910, and select an optimum hearing mode by comparing the determined surrounding condition and the current hearing mode. The controller 950 determines the hearing mode by analyzing the control signal received from the portable terminal 100, and compares the determined hearing mode and a surrounding condition obtained by analyzing the captured photo. If the hearing mode corresponds to the surrounding condition, the controller 950 sets the hearing aid in the hearing mode included in the control signal. If the hearing mode does not correspond to the surrounding condition, the controller 950 may set the hearing aid in a hearing mode corresponding to a surrounding condition determined from the captured photo or may operate the hearing mode in a hearing mode included in the control signal.

The controller 950 determines the surrounding condition by analyzing a photo in the same way as the algorithm as described above to analyze a photo captured by the portable terminal 100 to determine the surrounding condition. The controller 950 extracts features of at least one object contained in a photo captured by the photo shoot unit 910 and compares at least one object having outlines formed with the extracted features with objects stored beforehand. Based on the comparison, the controller 950 determines the surrounding condition. The features are formed along the contour of at least one object based on at least one of brightness and color to distinguish the size and type of the object.

The amplifier 970 applies a gain adjusted by the controller 950 on the analog signal received from the controller 950, and amplifies the signal with power from the power source 990 that corresponds to a set hearing mode. A method of controlling hearing mode of a hearing aid according to an embodiment of the present disclosure will now be described in detail in connection with FIG. 10.

Figure 10:
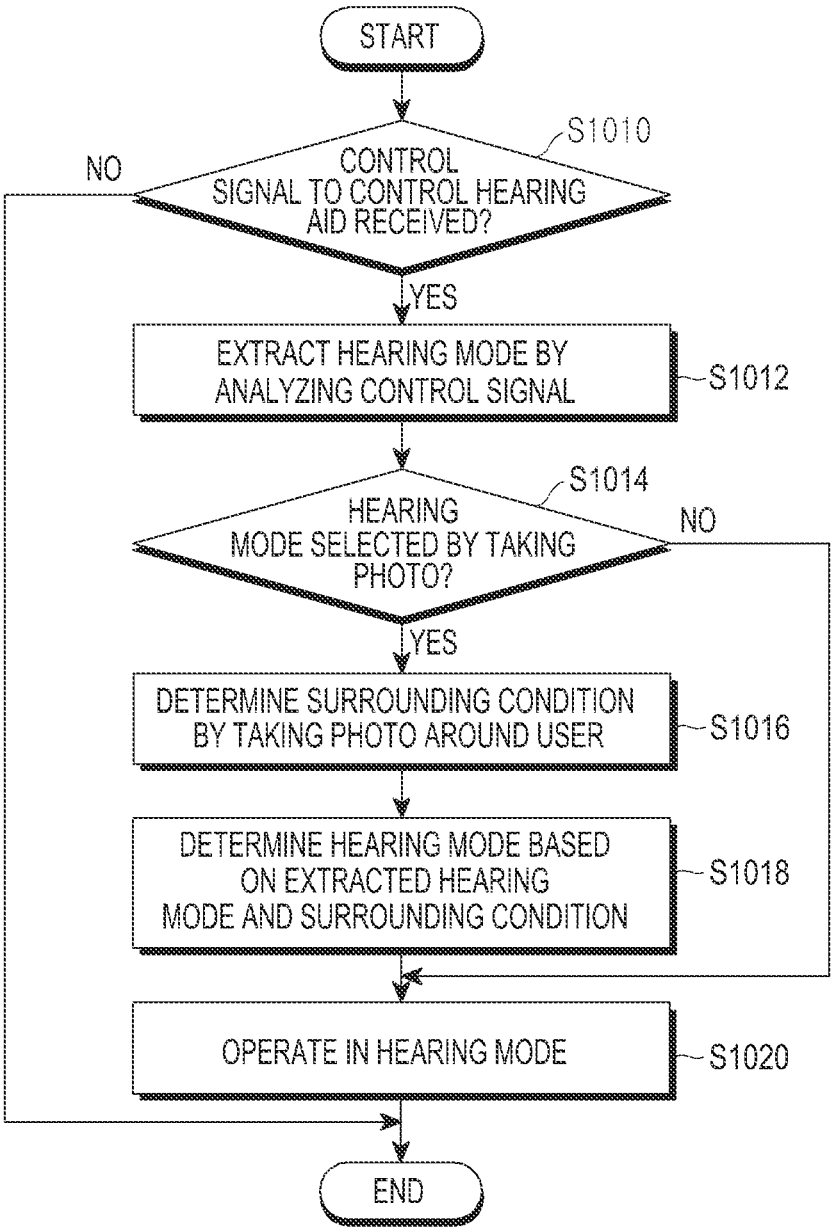
FIG. 10 is a flowchart illustrating a method of controlling a hearing mode of a hearing aid according to an embodiment of the present disclosure.

FIG. 10 is a flowchart illustrating a method of controlling hearing mode of a hearing aid according to an embodiment of the present disclosure.

Referring to FIG. 10, upon reception of a control signal to control the hearing aid, the hearing aid figures out a hearing mode by analyzing the control signal, in operations S1010 and S1012. The control signal includes information regarding hearing mode for a current surrounding condition by analyzing a surrounding condition determined in the portable terminal 100 and a surrounding sound detected in the portable terminal 100. The hearing aid receives the control signal and selects or changes into a hearing mode offered by the hearing aid based on the information included in the control signal reflecting the surrounding condition. A hearing mode of the hearing aid may be newly added or removed according to the control signal, and various hearing modes may be available, including not only silent mode, concert mode, crowd mode, landscape mode, rainy mode and class mode, but also certain hearing modes corresponding to all the surrounding conditions of the user wearing the hearing aid.

The hearing aid operates in the selected hearing mode, in operation S1020. The hearing mode amplifies a detected sound for output according to the surrounding condition. For example, if the surrounding condition is quiet, the hearing aid may amplify the sound with a small gain, and if the surrounding condition is noisy, the hearing aid may amplify the sound with a great gain. Such amplification control may be performed by the hearing aid itself or through the control signal received from the portable terminal 100. Since the portable terminal 100 and the hearing aid are typically carried and worn by the same person, the distance between the two is close. Thus, the portable terminal 100 may send the hearing aid a result of amplifying a detected sound based on the surrounding condition.

If a hearing mode is selected using the hearing mode contained in the control signal and a result of analyzing at least one object extracted from a photo in operation S1014, a photo of the user's surroundings is taken and the surrounding condition is determined from the photo in operation S1016. In an embodiment of the present disclosure, the hearing aid has a photo shoot unit 910 (e.g., camera unit) to take photos. The photo shoot unit 910 takes a photo of the surrounding condition and sends the photo to the controller 950. The controller 950 extracts features of at least one object included in the captured photo and detects the at least one object corresponding to the outline formed of the extracted features. The controller 950 then compares the detected at least one object with objects stored beforehand and determines the surrounding condition based on the comparison result, in operation S1016. In an embodiment of the present disclosure, a hearing mode of the hearing aid may be changed or selected based on the hearing mode contained in the control signal and the hearing mode obtained from the photo, or according the received control signal.

In operation S1018, the controller 950 determines the hearing mode based on the hearing mode contained in the control signal and the surrounding situation. The hearing aid may provide various hearing modes including silent mode, concert mode, crowd mode, landscape mode, rainy mode, class mode, and other various modes corresponding to various surrounding conditions. At least one of those modes may be newly added or removed by a hearing aid control application of the portable terminal 100. The hearing aid operates in the determined hearing mode, in operation S1020. After determining the hearing mode, the hearing aid controls a gain of output sounds according to the hearing mode. A method of controlling hearing mode of a hearing aid according to another embodiment of the present disclosure will now be described in detail in connection with FIG. 11.

Figure 11:
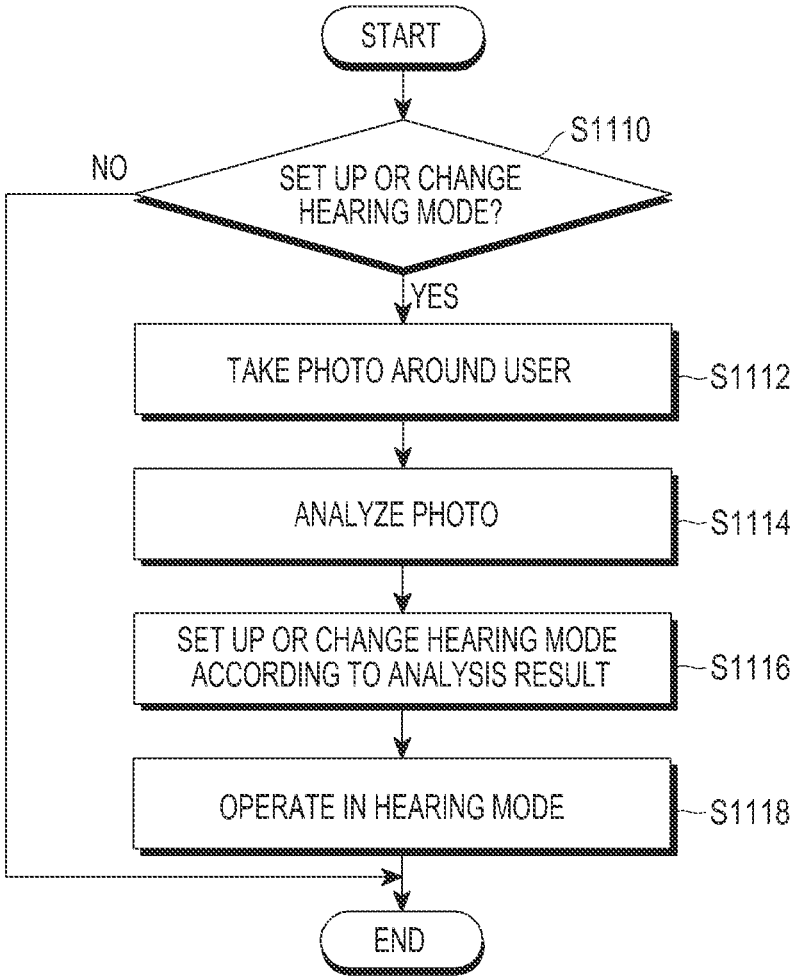
FIG. 11 is a flowchart illustrating a method of controlling a hearing mode of a hearing aid according to another embodiment of the present disclosure.

FIG. 11 is a flowchart illustrating a method of controlling hearing mode of a hearing aid, according to another embodiment of the present disclosure.

Referring to FIG. 11, if there is an attempt to set up or change a hearing mode of a hearing aid in operation S1110, the hearing aid uses the photo shoot unit 910 to take a photo of the surrounding condition in operation S1112. The surrounding condition may be a weather condition, such as rain or snow; a landscape such as a mountain, sea, or a field; or a certain situation such as a meeting or a concert. The surrounding condition may be determined by extracting outlines or features of at least one object present in an image or video captured around the user, and may include a concert condition, a crowd condition, a quiet landscape condition, a class condition, a speech condition, a rainy condition or a snowy condition, and any other conditions reflecting various surroundings of the user.

The photo captured in operation S1112 is analyzed in operation S1114. To adaptively change or select a hearing mode to fit the surrounding condition, the controller 950 extracts features of at least one object contained in the captured photo and detects the at least one object from outlines formed of the extracted features. The controller 950 then compares the detected at least one object with objects stored beforehand and determines the surrounding condition based on the comparison result. The controller 950 uses at least one object recognition algorithm to detect at least one object in the captured photo or image to determine the surrounding condition of the user wearing the hearing aid.

The object recognition algorithm (e.g., corner detection, Harris corner detection, or the like), detects objects in a photo, may be stored in the storage 960. The storage 960 may also store various algorithms to determine the surrounding condition from a captured image as well as various information necessary for each algorithm, which may be extracted from the image or video. The storage 960 may also store features and outlines of multiple objects to determine the surrounding condition, and features and outlines of various real-life objects. The controller 950 may detect the at least one object by extracting features or differences in color or brightness of the captured photo. The feature points are a minimum number of points left to characterize an object, resulting from elimination of overlapping, unimportant and unnecessary points from all the points that represent the object.

A hearing mode according to the analysis result of the captured photo is set up or changed in operation S1116. The hearing aid may provide various hearing modes including silent mode, concert mode, crowd mode, landscape mode, rainy mode, class mode, and other various modes corresponding to various surrounding conditions. The hearing mode may be changed or set up and at least one of those modes may be newly added or removed under control of the controller 950.

The hearing aid operates in the set up or changed hearing mode, in operation S1118. After determining the hearing mode, the hearing aid controls a gain of output sounds according to the hearing mode.

According to the various embodiments of the present disclosure, a user wearing a hearing aid may be given a better hearing service. Taking a photo to determine a surrounding condition and providing an adaptive hearing mode for the surrounding condition may enable the user who wears the hearing aid to hear more realistic sounds. Selecting a hearing mode using data obtained by analyzing a surrounding condition from a photo may provide more realistic sounds to the user wearing the hearing aid.

It will be appreciated that the various embodiments of the present disclosure may be implemented in a form of hardware, software, or a combination of hardware and software. The software may be stored as program instructions or computer readable codes executable on the processor on a non-transitory computer-readable medium. Examples of the computer readable recording medium include magnetic storage media (e.g., ROM, floppy disks, hard disks, etc.), and optical recording media (e.g., CD-ROMs, or DVDs). This media can be read by the computer, stored in the memory, and executed by the processor. The memory included in the portable terminal may be an example of the non-transitory computer readable recording medium suitable for storing a program or programs having instructions that implement the embodiments of the present disclosure. The present disclosure may be implemented by a program having codes for embodying the method described in claims, the program being stored in a machine readable storage medium.

The portable terminal may receive and store the program from a program provider wiredly/wirelessly connected thereto. The program provider may include a program having instructions for the portable terminal to perform the method, a memory for storing information required for the method, a communication unit for wiredly/wirelessly communicating with the portable terminal, and a controller for receiving a request from the mobile terminal and delivering corresponding programs to the portable terminal.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. A method for controlling a hearing aid using an electronic device, the method comprising:

capturing an image;

detecting at least one object in the image by extracting features of the captured image;

analyzing the at least one object to determine a surrounding situation;

generating a control signal based on the determined surrounding situation to control a hearing mode of the hearing aid; and transmitting the control signal to the hearing aid, wherein the extracted features comprise points formed along a contour of the detected at least one object.

2. The method of claim 1, wherein the control signal is generated by using the surrounding situation and a surrounding sound detected by the electronic device, and wherein the control signal is used to select a proper hearing mode suitable for the surrounding situation from among multiple hearing modes that the hearing aid offers.

3. The method of claim 1, further comprising:

running an application to control change of the hearing mode, wherein the application includes at least one of an image shoot menu to capture the image, an analysis menu to analyze the captured image, a volume menu to control a volume of the hearing aid, a threshold menu to adjust thresholds to be set for analysis of the captured image, and a hearing mode menu to select a proper hearing mode suitable for the surrounding situation.

4. The method of claim 3, wherein the application includes at least one menu, and wherein the at least one menu is automatically or manually established based on analysis of the surrounding situation.

5. The method of claim 3, wherein the hearing mode is newly added or removed based on the surrounding situation of the image.

6. The method of claim 1, wherein the generating of the control signal comprises:

comparing the at least one object, which has an outline formed by the extracted features, with a stored object; and determining the surrounding situation based on the comparison.

7. The method of claim 6, wherein the features are formed along an outline of the at least one object based on at least one of brightness and color to distinguish a size and type of the at least one object.

8. The method of claim 6, further comprising:

determining whether the determined surrounding situation matches a surrounding sound detected by the electronic device.

9. The method of claim 1, wherein the hearing mode comprises at least one of silent mode, concert mode, crowd mode, landscape mode, rainy mode, and class mode.

10. The method of claim 2, wherein the control signal comprises at least one of absolute sound level information, signal envelope information, spectral content information, and directional microphone information.

11. An electronic device for controlling a hearing aid, the electronic device comprising:

a camera configured to capture an image;

a controller configured to:

detect at least one object in the image by extracting features of the image, analyze the at least one object to determine a surrounding situation, and generate a control signal based on the determined surrounding situation to control a hearing mode of the hearing aid; and a transceiver configured to transmit the control signal to the hearing aid, wherein the extracted features comprise points formed along a contour of the detected at least one object.

12. The electronic device of claim 11, further comprising:

a microphone to detect a surrounding sound to generate the control signal.

13. The electronic device of claim 11, wherein the controller is further configured to:

compare the at least one object, which has an outline formed by the extracted features, with a stored object, and determine the surrounding situation based on the comparison.

14. The electronic device of claim 13, wherein the controller is further configured to determine whether the determined surrounding situation matches a surrounding sound detected by the electronic device.

15. The electronic device of claim 12, wherein the control signal is generated by using the surrounding situation and the surrounding sound, and wherein the control signal is used to select a proper hearing mode suitable for the surrounding situation from among multiple hearing modes the hearing aid offers.

16. The electronic device of claim 12, wherein the controller is further configured to:

determine whether a hearing mode determined from the surrounding sound matches the determined surrounding situation, and if the hearing mode determined from the surrounding sound does not match the determined surrounding situation, change the hearing mode to a hearing mode corresponding to the surrounding situation.

17. A method of changing a hearing mode in a hearing aid, the method comprising:

receiving a control signal that is based on a determined surrounding situation to control the hearing mode of the hearing aid from an electronic device, the surrounding situation being determined by detecting at least one object in an image by extracting features of the image and analyzing the at least one object;

extracting a hearing mode according to an analysis of the control signal; and changing the hearing mode of the hearing aid to the extracted hearing mode, wherein the extracted features comprise points formed along a contour of the detected at least one object.

18. The method of claim 17, further comprising:

capturing the image;

determining if the surrounding situation matches the extracted hearing mode; and changing the hearing mode of the hearing aid to a hearing mode suitable for the surrounding situation if the surrounding situation does not match the extracted hearing mode.

19. The method of claim 17, wherein the control signal controls a hearing mode of the hearing aid according to an analysis of the surrounding situation from the image captured by the electronic device.

20. The method of claim 17, wherein the control signal controls a hearing mode of the hearing aid according to an analysis of the image captured by the electronic device and a surrounding sound detected by the electronic device.

21. A hearing aid comprising:

a radio frequency (RF) unit configured to:

transmit to an electronic device at least one hearing mode that the hearing aid offers, and receive from the electronic device a control signal based on a determined surrounding situation to change a hearing mode of the hearing aid to another hearing mode, the surrounding situation being determined by detecting at least one object in an image by extracting features of the image and analyzing the at least one object; and a controller configured to:

extract a hearing mode from the control signal, and control a hearing mode of the hearing aid to be changed to the hearing mode extracted from the control signal, wherein the extracted features comprise points formed along a contour of the detected at least one object.

22. The hearing aid of claim 21, further comprising:

an image shoot unit configured to capture the image.

23. The hearing aid of claim 22, wherein the controller is further configured to change a hearing mode of the hearing aid to a hearing mode suitable for the surrounding situation if the determined surrounding situation does not match the extracted hearing mode.

24. The hearing aid of claim 21, wherein the control signal controls a hearing mode of the hearing aid according to an analysis of the determined surrounding situation from the image captured by the electronic device.

25. The hearing aid of claim 21, wherein the control signal controls a hearing mode of the hearing aid according to an analysis of the determined surrounding situation and a surrounding sound detected by the electronic device.

26. A method for changing a hearing mode in a hearing aid, the method comprising:

capturing an image;

detecting at least one object in the image by extracting features of the image;

determining a surrounding situation by analyzing the detected at least one object of the image;

generating a control signal based on the determined surrounding situation;

changing the hearing mode of the hearing aid according to the control signal; and outputting a sound in the hearing mode, wherein the extracted features comprise points formed along a contour of the detected at least one object.

27. The method of claim 26, wherein the determining of the surrounding situation comprises:

comparing the extracted features with a stored object; and determining the surrounding situation based on the comparison.

28. The method of claim 27, wherein the features are formed along an outline of the at least one object based on at least one of brightness and color to distinguish a size and type of the at least one object.

29. The method of claim 27, further comprising:

determining if the determined surrounding situation matches a surrounding sound detected by the hearing aid.

30. The method of claim 26, wherein the hearing mode comprises at least one of silent mode, concert mode, crowd mode, landscape mode, rainy mode, and class mode.

31. The method of claim 30, wherein the hearing mode is determined based on at least one of absolute sound level information, signal envelope information, spectral content information, and directional microphone information.

32. A hearing aid comprising:

an image shoot unit configured to capture an image;

a controller configured to:

detect at least one object in the image by extracting features of the image, analyze the at least one object to determine a surrounding situation, generate a control signal based on the determined surrounding situation, and control a hearing mode of the hearing aid according to the control signal; and an output unit configured to output a sound in the hearing mode, wherein the extracted features comprise points formed along a contour of the detected at least one object.

33. The hearing aid of claim 32, wherein the controller is further configured to compare the extracted features with a stored object.

34. The hearing aid of claim 33, wherein the controller is further configured to determine if the determined surrounding situation matches a surrounding sound detected by the hearing aid.

* * * * *